United States Patent [19]

Wolter

[11] Patent Number: 4,521,833

[45] Date of Patent: Jun. 4, 1985

[54] LIGHT

[76] Inventor: Heinz Wolter, Meiswinkel 3, D-5067 Kürten, Fed. Rep. of Germany

[21] Appl. No.: 642,001

[22] Filed: Aug. 17, 1984

[30] Foreign Application Priority Data

Aug. 20, 1983 [DE] Fed. Rep. of Germany ..... 3330179

[51] Int. Cl.[3] ..... F21V 33/00

[52] U.S. Cl. ..... 362/116; 362/100; 362/189; 362/200; 362/205; 362/208; 362/295; 70/456 R

[58] Field of Search ..... 362/116, 100, 189, 200, 362/205, 208, 295; 70/456 R

[56] References Cited

U.S. PATENT DOCUMENTS

| | | | |
|---|---|---|---|
| 2,393,373 | 1/1946 | Hendrix | 362/116 X |
| 3,085,149 | 4/1963 | Giwosky | 362/116 |
| 3,310,668 | 3/1967 | Schwartz | 362/116 |
| 4,085,315 | 4/1978 | Wolter et al. | 362/116 |
| 4,276,582 | 6/1981 | Burnett | 362/116 |
| 4,303,966 | 12/1981 | Wolter | 362/116 |
| 4,392,186 | 7/1983 | Cziment | 362/116 |

*Primary Examiner*—Stephen J. Lechert, Jr.
*Attorney, Agent, or Firm*—Martin A. Farber

[57] ABSTRACT

The invention concerns a light within whose handle-forming plastic housing (2) a button-cell battery (3) provided with a circumferential and a center surface pole can be brought into the switch-contact position against the force of a compression spring (6), a portion of the center surface pole (MP) of the button-cell battery coming into contact with a portion of a ring-shaped contact blade (9), the compression spring being arranged concentrically to the ring-shaped section (9') which rests on the housing bottom and the circumferential pole (UP) of the button-cell battery being in continuous contact (permanent contact) with a contact spring (16) which extends substantially tangentially to the button-cell battery, and it proposes, in order to obtain a shape which is simple to manufacture, compact and reliable in use, that the compression spring (6) lie free of contact in the opening (10) of the circular ring-shaped section (9') lying on the housing bottom (7) and, in the switch-contact position of the center surface pole (MP) of the button-cell battery (3) comes onto the ring-shaped section (9'). This shape of light can be developed so compactly that it can be used as actuating handle for a key.

10 Claims, 21 Drawing Figures

FIG. 2
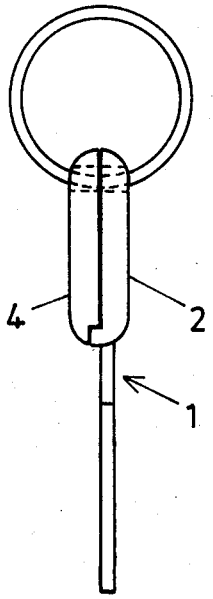
FIG. 1
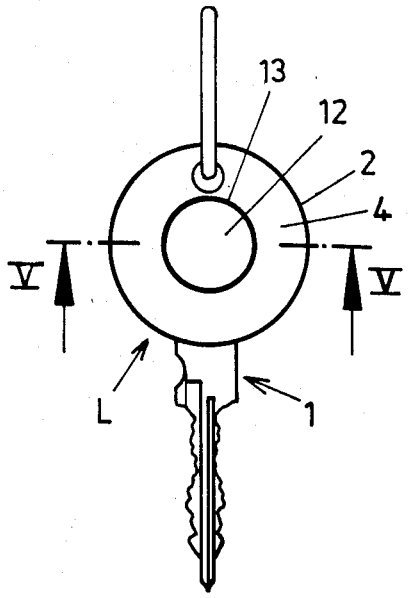
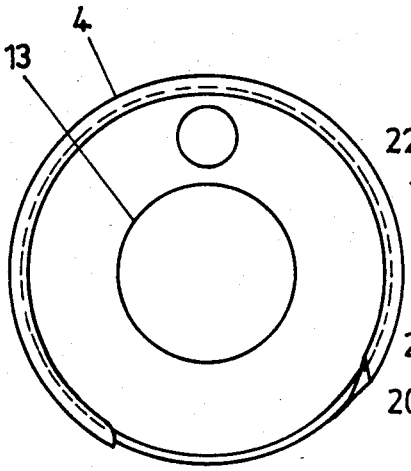
FIG. 4
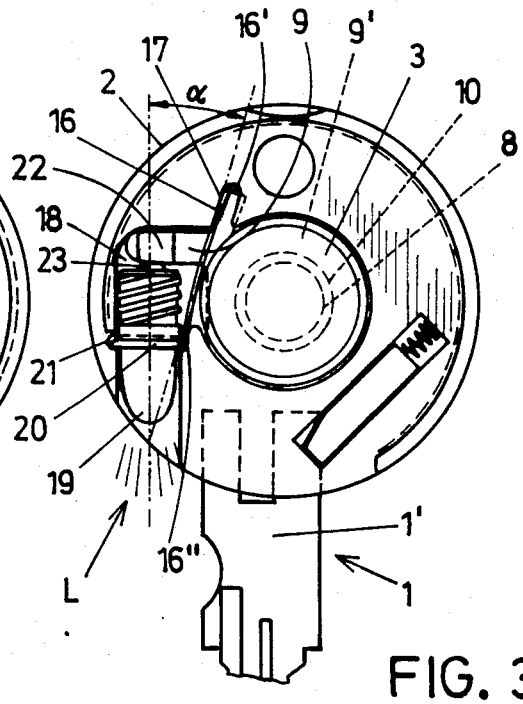
FIG. 3

LIGHT

The present invention refers to a light within whose handle-forming plastic housing a button-cell battery provided with a circumferential and a center surface pole can be brought into the switch contact position against the force of a compression spring, a portion of the center surface pole of the button-cell battery coming into contact with a portion of a ring-shaped contact blade, the compression spring being arranged concentrically to the ring-shaped section which rests on the bottom of the housing and the circumferential pole of the button-cell battery being in continuous resting contact (permanent contact) with a contact spring which extends tangentially to the button-cell battery.

A light of this kind is known from Federal Republic of Germany Utility Model No. 18 50 084, in which continuous contact also exists with respect to the permanent circumferential contact between button-cell battery and adjoining contact blade. This light is, however, difficult to operate, since the compression spring is formed of a closed rubber ring which must be squeezed together with the use of considerable force in order to make contact. In this case a push-button actuation which is as central as possible is necessary so that the central contact can come into contact with the highly arched tongue of the contact blade which lies on the bottom of the housing. If the push-button actuation is effected more in the vicinity of the edge, a larger stroke is required as a result of the tilting.

A light which can be combined with a key is known from Federal Republic of Germany OS No. 31 26 774. In that case, however, the compression spring forms a continuous conductive bridge between the center surface pole and the contact blade lying on the bottom of the housing. The ring-shaped section which is arranged over-hung there cooperates with an inwardly bent wall region of the button-cell battery which is closer to the center surface pole. Even slight displacements—for instance merely displacements resulting from tolerance—of the contact parts with respect to each other can lead to a bridging-over of the poles, which are separated from each other only by an extremely narrow insulated zone. As a whole, a relatively large housing is necessary due to the required safety spacing between the ring-shaped section which is arranged freely-overhung and the button-cell battery.

The object of the invention is to provide a light of this type in a form which is simpler to manufacture, extremely flat and dependable in operation, and of such small structural shape that it can be readily integrated with a key so as to form a key light.

This object is achieved by the invention set forth in claim 1.

The subordinate claims set forth further advantageous developments of the object of the invention.

As a result of this embodiment there is obtained a light of high reliability in operation and simple construction which can be favorably associated with a key in view of its extremely flat shape. Even when taking into account the tilted position of the button-cell battery, which cannot be prevented upon actuation, the flat center surface pole which protrudes slightly from the shell of the button-cell battery comes with dependable switch contact at all times onto the underlying, circular ring-shaped section supported by the bottom of the housing. Since different places close to the edge will constantly cooperate with each other as a result of the tilting being possible in many directions, this does not so readily lead to the danger of scale being formed. Rather, a self-cleaning action is obtained at the contact points. This contact close to the edge is covered in a light of this type by a rubber ring which lies in this region and forms the compression spring. Furthermore, the stroke can now be reduced substantially and thus, also, the structural height. The structural association of the contact spring is also simple to install and reliable in operation: It lies in a shaft within the housing, in such a manner that its one end intersects the receiving space for the incandescent bulb on the peripheral side. It is advantageous, in this connection, that the contact spring extend at an acute angle to the receiving space which is directed parallel to the key shaft. As for the compression spring, one advantageous arrangement is for its bottom end turn to lie in a depression with the bottom of the housing whose diameter is less than the diameter of the opening in the ring-shaped section. A central position of the compression spring is thus definitely assured: No transverse displacement can take place. Finally, in case of the use of a conical spring the embedding of the end turn of the compression spring contributes furthermore to obtaining a structural shape which is as flat as possible. In order, furthermore, to assure at all times a reliable making of contact with the incandescent bulb regardless of certain deviations in tolerance of the ward parts, the invention further proposes that the contact blade rest against the base of the incandescent bulb via a contact lug which is bent off at an angle from the plane of the ring-shaped section on the other side of the contact spring and that the contact lug thus formed is furthermore urged into contact by an elastic body which is supported on the housing side. In this connection, it proves advantageous for the elastic body to be of cylindrical shape, to extend within a shaft and to have a holding-down member arranged above it on the lid of the housing. The corresponding resilient application can, however, also be utilized for the contact spring, in the manner that the free end of the contact spring, which is in continuous contact on the circumferential-surface pole rests resiliently against the base of the incandescent bulb and is urged additionally into contact there by a resilient or spring body (FIG. 20). For the optimum fixing of the ring-shaped section, it is finally advantageous for the ring-shaped section of the contact blade to have on its edge a plurality of claws arranged substantially at an equal angular distance apart which engage in hook fashion in the cylindrical wall of the reception chamber for the button-cell battery. In this connection, it is particularly favorable if the claw engagement takes place in guide shafts which extend in the direction of insertion.

The object of the invention is explained in further detail below with reference to three embodiments shown in the drawing, in which:

FIG. 1 shows the light combined with the key in approximately true size, in accordance with the first embodiment;

FIG. 2 is a side view thereof;

FIG. 3 is an inner view, on a larger scale, of the housing with the key in the actuating position;

FIG. 4 is a view of the inside of the corresponding housing cover;

The grip-region of the key 1 is developed as a light L. The housing 2, which forms the handle of the key, receives a button-cell battery 3, in its center.

The flat housing, disc-shaped in FIG. 1, is formed of insulating material, for instance plastic, and can be closed by a ring-shaped cover 4 by means of a snap-edge connection.

Figure 5:
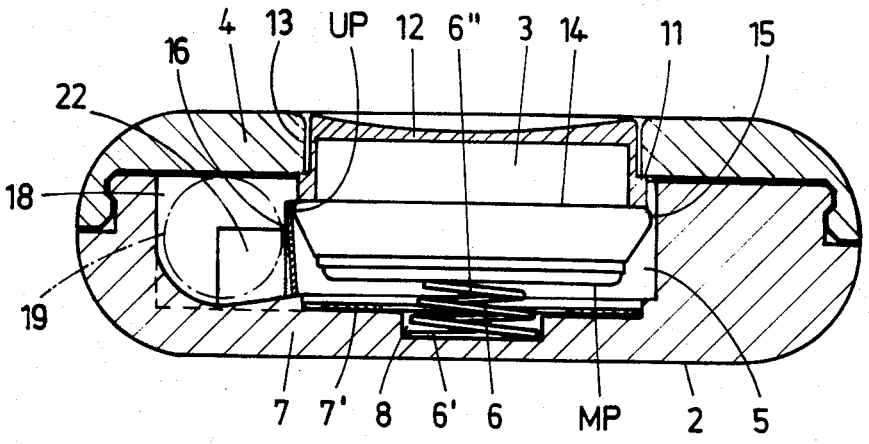
FIG. 5 is a section along Line V—V of FIG. 1, shown in the basic position.

From the wide surface of the housing 2, which faces the cover 4, a central, cylindrical receiving chamber 5 extends for the button-cell battery 3. The battery is displaceable axially therein against spring pressure. The corresponding compression spring 6 rests on the bottom 7, of the receiving chamber 5. At least its bottom end-turn 6′ extends into a recess 8 in the bottom 7. The spring is a conical spring whose other end-turn 6″ acts centrally against the bottom, flat side of the button-cell battery 3, urging it in the direction of the basic position (FIG. 5).

On the housing bottom 7 there furthermore lies the ring-shaped section 9′ of a contact blade 9. This is a stamped part which is flat, at least in the region of its ring-shaped section. The ring-shaped section 9′ leaves such a wide free inner space that the compression spring 6, seated in the recess 8, does not come into contact with the conductive contact blade 9. The diameter of the recess 8 is rather considerably less than that of the opening 10 in the ring-shaped section.

Figure 6:
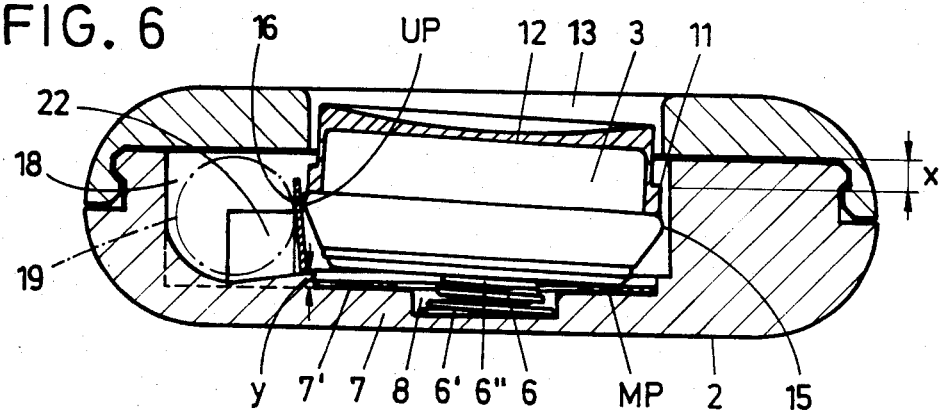
FIG. 6 is a corresponding section in the actuation position.
Figure 7:
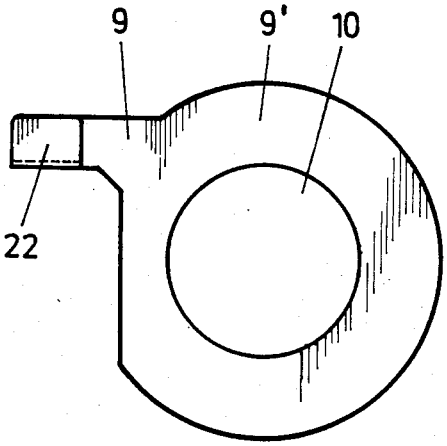
FIG. 7 is a detail top view of the contact blade having the ring-shaped section.
Figure 8:
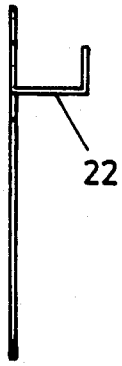
FIG. 8 is the corresponding side view.
Figure 9:
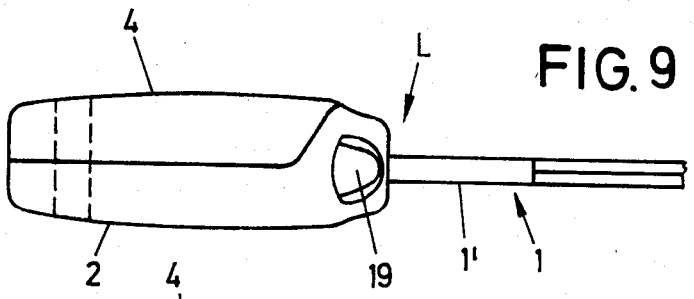
FIG. 9 shows the light combined with a key in accordance with the second embodiment, shown in side view.
Figure 10:
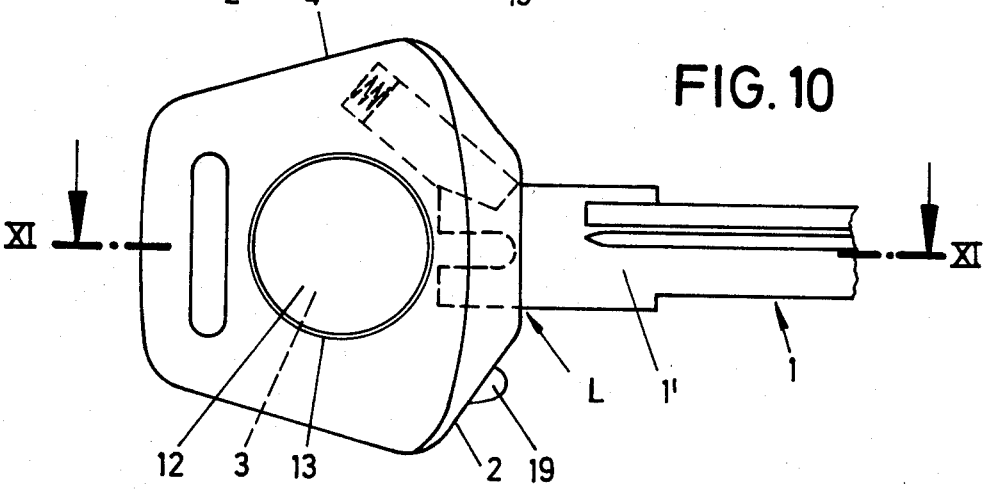
FIG. 10 is a top view thereof.
Figure 11:
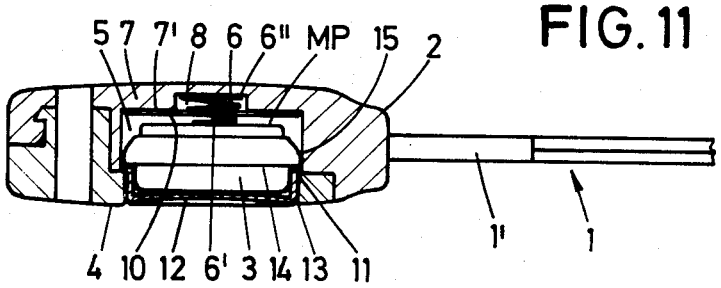
FIG. 11 is a section along the Line XI—XI in FIG. 10.
Figure 12:
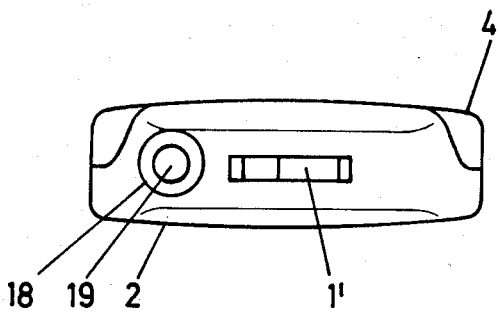
FIG. 12 is an end view of the light looking at the incandescent bulb.
Figure 14:
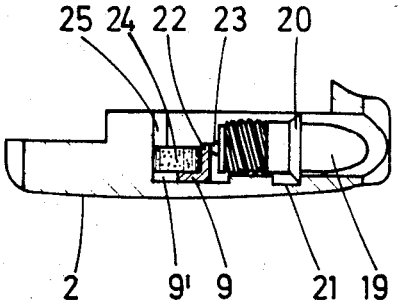
FIG. 14 is a section along the Line XIV—XIV of FIG. 13.

In contact position (FIG. 6), the center surface pole MP of the button-cell battery 3 which is formed by the flat lower side, rests against the side of the ring-shaped section 9′ which faces it.

The spring-urged basic position is, on the other hand, defined by an annular shoulder 11 on a cap-shaped actuating button 12, which extends over the button-cell battery 3. The cylindrical section of smaller cross section of the actuating button extends into a continuous hole 13 of corresponding shape in the cover 4. The annular shoulder 11 strikes against the bottom inner edge of the opening 13. The cap space receives the upper, cylindrical section of the button-cell battery, which battery widens to the circumferential dimension thereof in the region of the lower edge of the cap and, finally, terminates in shallow frustoconical shape in the direction towards the bottom 7. The step shoulder between the cylindrical and frustoconical sections of the button-cell battery is designated 14. The peripheral transition has a transverse rounding 15. The circumferential wall of this section forms the circumferential pole UP.

The circumferential pole UP is in continuous contact with a contact spring 16, which extends substantially tangentially to the button-cell battery 3. The width of the spring corresponds at least to the stroke x of the button-cell battery. The contact spring is held in a shaft 17 (FIGS. 3 and 13) in the housing 2. The shaft 17 terminates at a distance y (FIG. 6) in front of the receiving-chamber surface 7′ of the bottom 7 on the receiving-chamber side, which distance is greater than the thickness of the contact blade 9. Thus, there cannot be any contact between the blade and the contact spring 16. Adjoining the cylindrical receiving chamber 5 in the direction towards the edge of the housing, there is a receiving space 18 for the incandescent bulb 19, of the light L. The receiving space 18 and the receiving chamber 5 are open towards each other over a part of their sections. The contact spring 16 extends within the corresponding open region and is secured merely at its two narrow ends 16′ and 16″ so that, upon the downward displacement of the button-cell battery, its spring finds space to move into there; the shaft 17, namely, has an oblique course lying in the direction of displacement. This has the advantage that with increasing movement of depression, even firmer frictional contact is produced between the circumferential pole and the corresponding spring surface.

Figure 13:
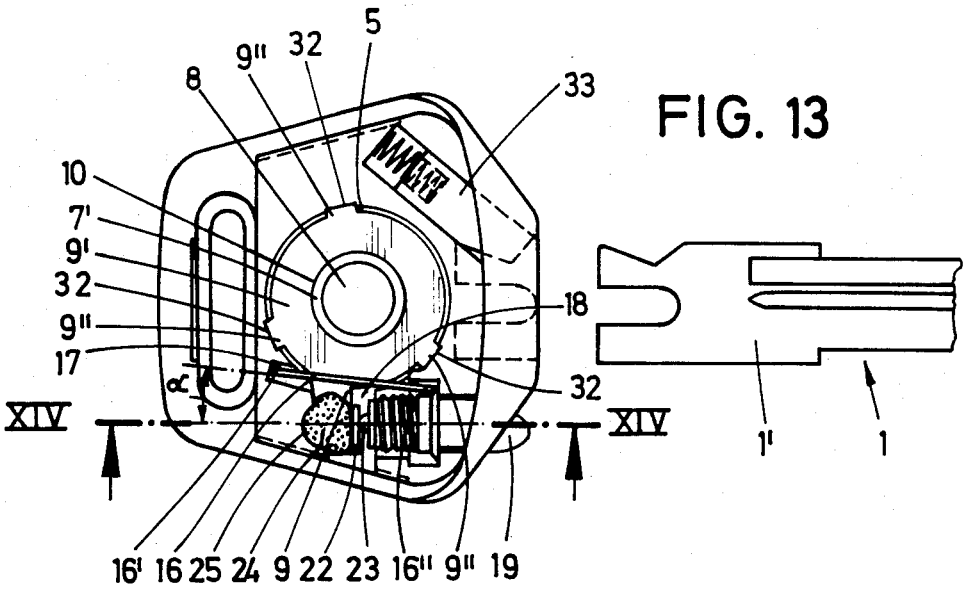
FIG. 13 is an interior view of the light housing with the cover removed and the key shank not yet attached.

The incandescent bulb 19 forms an annular collar 20 in front of the glass envelope. The collar extends within a transverse shaft 21 of the housing 2. The bulb 19 is directed in the direction of the key shaft. It extends in the plane of the narrow edge of the key. The contact spring extends at an acute angle (angle alpha) to the receiving space which is directed parallel to the key shaft 1′ (FIGS. 3 and 13).

The contact lug 22 of the contact blade 9, which lug is bent off from its flat plane on the other side of the contact spring 16, extends up into the region of the base 23 of the bulb. The lug initially assumes an approximately tangential course to the ring-shaped section 9′, and is then bent away once or twice transverse to the direction of its length.

The tangentially directed contact spring 16, at its one end, i.e. the bulb-side end, intersects the receiving space for the incandescent bulb and comes against the threaded wall of the bulb 19, and specifically against the annular collar 20 produced by outward bending, said collar being continued towards the rear by an unthreaded cylindrical section so that the contact is always reliably maintained over the narrow end 16″.

The actuating button terminates on the edge side flush with the outer wide surface of the cover 4, but it is slightly concave towards the center. The cover 4 also closes off the receiving space 18 for the bulb 19, which space is open towards the top. The depth of the space corresponds essentially to the diameter of the bulb.

In order to actuate the light, it is not necessary to act strictly centrally; due to the ring-shaped section 9′, a part of the button-cell battery always comes into contact with the ring-shaped section regardless of the position into which the button-cell battery is tilted.

Figure 15:
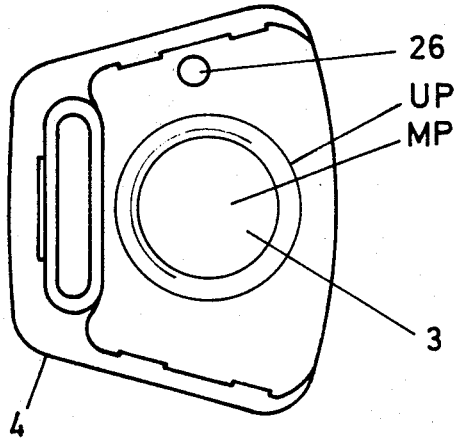
FIG. 15 is a view of the inside of the housing cover.

The lights having a key shaft according to the second and third embodiments are in principle of the same construction. Insofar as necessary for understanding, the reference numbers have been applied by analogy without regard to those features which are the same. In the case of the second embodiment (FIGS. 9 to 15), there is the following further development: The contact lug 22 of the contact blade 9, which lug lies resiliently against the bulb base 23, is acted on further, in order to increase the resilient application, by an elastic member 24, for instance of foam, which urges it in the direction of the bulb 19. The body, which is basically cylindrical, rests in a shaft 25 provided in the housing 2 behind the lamp base. The shaft is formed in part by the receiving space 18. For the introduction of the plug-like body 24, the latter is compressed slightly. The restoring force leads to the the somewhat deformed shape which can be noted in FIG. 13. In order that the elastic member 24 cannot emerge from the shaft or than an axial length which is reduced with respect to the height of the shaft cannot be present, a holding-down device 26 extends from the housing cover 4, with which it is flush. It is a cylindrical pin developed thereon which extends to the top of the elastic body. The pin can be noted in FIG. 15.

While in this embodiment and in the embodiment shown in FIGS. 1 to 8, the contact blade 9 extends to the bulb base 23, in the embodiment shown in FIGS. 16 to 21 the contact blade 9 extends to the annular collar 20 of the bulb 19, and the contact spring 16, which is in continuous contact with the circumferential flat pole UP, makes contact at its free end with the bulb base 23. This can be noted clearly from FIG. 20. As can be seen, the contact spring 16 has a multiply bent course, the end which is directly in contact being bent in V-shape and the tip of the V lying against the bulb base 23. Aside from the force of application inherent in the contact spring, this free end is also urged into position by a resilient or spring-like body 24'. This body consists of a plate which is inserted diagonally into the region of the shaft present there and rests there against the free V-arm, urging it into position.

Figure 16:
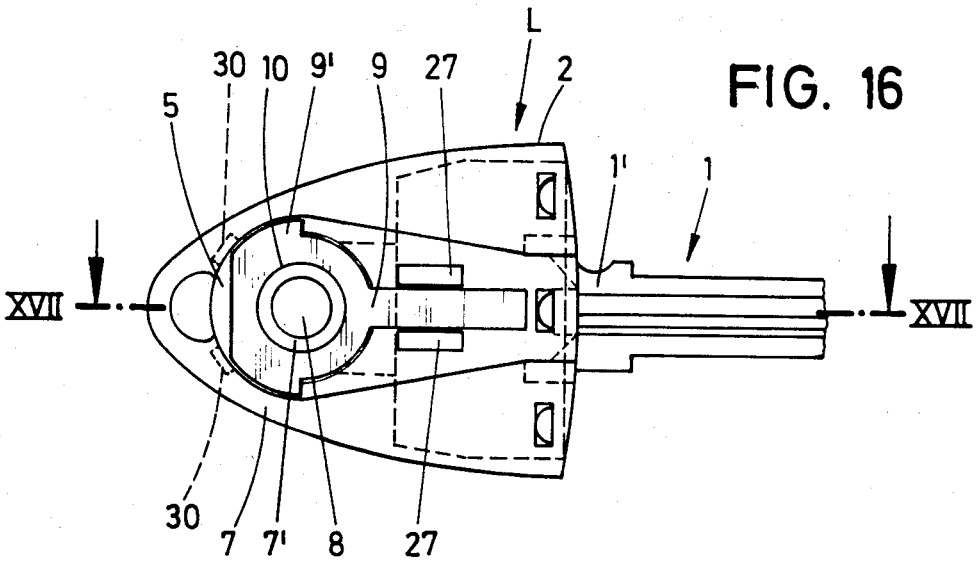
FIG. 16 shows the light combined with a key in accordance with the third embodiment, with the housing cover removed.
Figure 17:
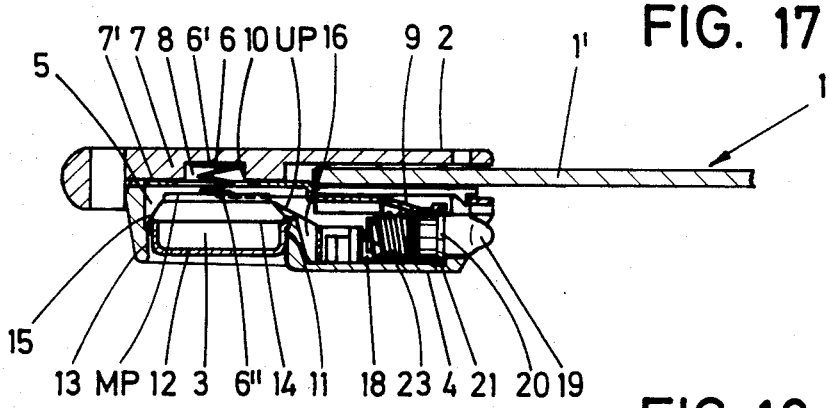
FIG. 17 is a section along the Line XVII—XVII of FIG. 16, with the housing cover, however, attached.
Figure 18:
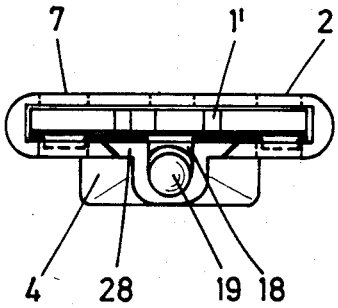
FIG. 18 is an end view looking at the incandescent bulb.

As further difference from the preceding solutions, the measure has been taken that the contact blade 9 extends in the direction of the key shaft (FIG. 16). Its lateral support is formed by ribs 27 which extend laterally of the contact blade 9. The basic shape of the light also differs insofar as it now has a substantially triangular course with slightly convexly curved longitudinal sides. The snap attachment of the cover is also different since it forms a hammerhead 28, with lateral beveled lugs which engage behind corresponding undercuts in the housing 2. The end of the cover 4 lying opposite the hammer-head 28, on the other hand, is simply snapped into the receiving chamber 5 for the button-cell battery 3. The latter has corresponding detent depressions 20 into which the detent projections 31 of the cover 4 snap.

One special feature of the embodiment in accordance with FIGS. 9 to 15 is, furthermore, that the ring-shaped section 9' of the contact blade 9 has, on its periphery, a plurality of claws 9'', arranged substantially at an equal distance apart, which engage in the cylindrical wall of the receiving chamber 5 for the button-cell battery 3. The engagement is effected on basis of guide shafts 32, which extend in the direction of insertion of the ring-shaped section 9' and which are correspondingly adapted to the contour of the claws 9'' and provide optimum assurance against the circular ring-shaped section 9' turning.

In this same embodiment, the insertion-side end of the key shaft 1' is forked. It enters into a shaft in the housing corresponding to the forked shape and is fixed in eliminatable manner by a locking bolt 33 which is urged by spring in the direction of the basic locking position.

All new features mentioned in the specification and shown in the drawing are essential to the invention, even if they are not expressly set forth in the claims.

I claim:

1. A light, within whose handle-forming plastic housing (2) a button-cell battery (3) provided with a circumferential and a center surface pole can be brought into the switch-contact position against the force of a compression spring (6), a portion of the center surface pole (MP) of the button-cell battery coming into contact with a portion of a ring-shaped contact blade (9), the compression spring being arranged concentrically to the ring-shaped section (9') which rests on the housing bottom (7) and the circumferential pole of the button-cell battery being in continuous contact (permanent contact) with a contact spring (16) which extends tangentially to the button-cell battery, the width of which spring corresponds at least to the stroke of the button-cell battery, characterized by the fact that the compression spring (6) lies, free of contact, in the opening (10) of the circular ring-shaped section (9') lying on the housing bottom (7) and in switch-contact position of the central-surface pole (MP) of the button-cell battery (3) comes onto the ring-shaped section (9').

2. A light according to claim 1, characterized by the fact that the contact spring (16) lies within a shaft (17) of the housing (2) and that its one end intersects on the periphery of the receiving space (18) for the incandescent bulb (19).

3. A light according to claim 1, characterized by the fact that the bottom-side end turn (6') of the compression spring (6) lies in a recess (8) in the housing bottom (7) the diameter of which recess is smaller than the diameter of the opening (10) of the ring-shaped section.

4. A light according to claim 2, characterized by the fact that the contact spring (16) extends at an acute angle (angle alpha) to the receiving space (18) which is aligned parallel to the key-shank insertion shaft.

5. A light according to claim 2, characterized by the fact that the contact spring (16) which is mounted only at its two narrow ends (16', 16'') is recessed in slightly tilted position to the axis of displacement of the button-cell battery.

6. A light according to claim 1, characterized by the fact that the contact blade (9) rests, via a contact lug (22) which is bent off from the plane of the ring-shaped section (9') on the other side of the contact spring (16), against the bulb base (23) and the contact lug (22) thus formed is, in addition, urged into its position of application by an elastic body (24) supported on the housing side.

7. A light according to claim 6, characterized by the fact that the elastic body (24) is of cylindrical shape, extends within a shaft (25), and has a holding-down device (26) of the housing cover (4) arranged above it.

Figure 20:
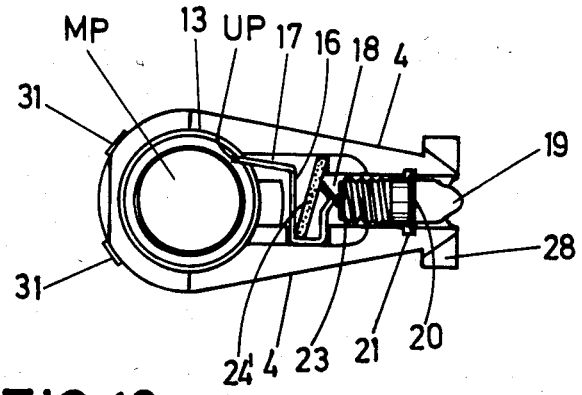
FIG. 20 is an inner view looking at the equipped cover.
Figure 19:
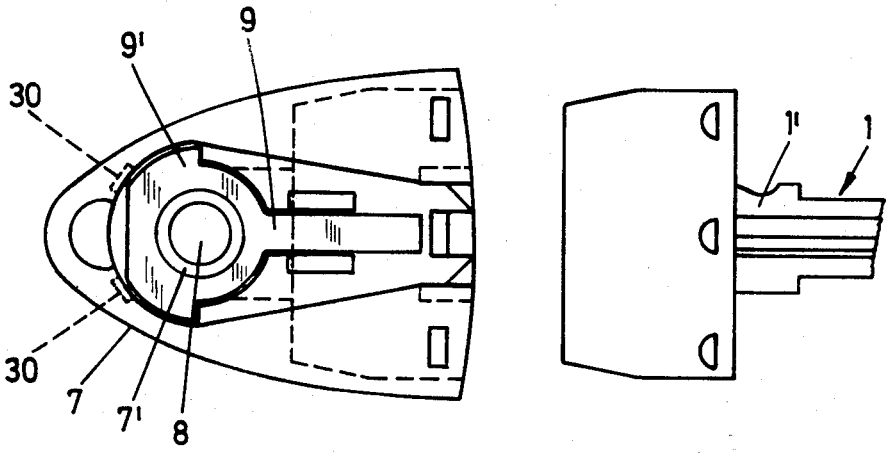
FIG. 19 is a view of the inside of the housing with the key still not attached and the housing cover removed.
Figure 21:
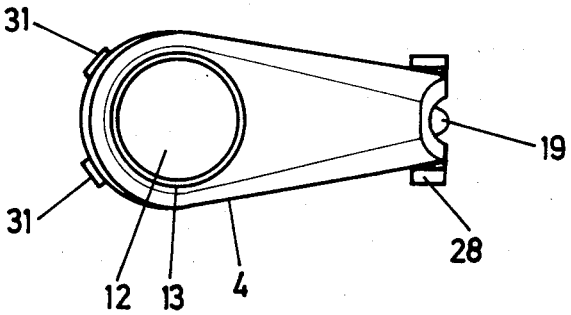
FIG. 21 is a top view of said cover.

8. A light according to claim 1, characterized by the fact that the contact spring (16) which is in continuous contact with this circumferential surface pole (UP) rests with its free end resiliently against the base (23) of the bulb and is additionally urged into application there by a resilient or spring body (FIG. 20).

9. A light according to claims 1 and 3, characterized by the fact that the ring-shaped section (9') of the contact blade (9) is provided on its edge with a plurality of claws (9'') arranged substantially at equal angular distance apart, which engage in hook-like manner in the cylindrical wall of the receiving chamber (5) for the button-cell battery (3).

10. A light according to claim 1, characterized by the fact that the engagement takes place in guide shafts (32) which extend in the direction of insertion.

* * * * *